US005551344A

United States Patent [19]

Couet et al.

[11] Patent Number: 5,551,344

[45] Date of Patent: Sep. 3, 1996

[54] METHOD AND APPARATUS FOR OVERBALANCED PERFORATING AND FRACTURING IN A BOREHOLE

[75] Inventors: Benoit Couet, Bethel; Luc Petijean, Danbury; Luis C. Ayestaran, Ridgefield, all of Conn.

[73] Assignee: Schlumberger Technology Corporation, Ridgefield, Conn.

[21] Appl. No.: 258,115

[22] Filed: Jun. 10, 1994

Related U.S. Application Data

[63] Continuation-in-part of Ser. No. 975,497, Nov. 10, 1992, Pat. No. 5,355,802.

[51] Int. Cl.[6] ..... F42B 3/00

[52] U.S. Cl. ..... 102/312; 102/313; 102/325; 102/333

[58] Field of Search ..... 102/312, 313, 102/325, 333; 175/4.59

[56] References Cited

U.S. PATENT DOCUMENTS

| | | | |
|---|---|---|---|
| 3,011,551 | 12/1961 | Young et al. | 175/4.59 X |
| 3,174,545 | 3/1965 | Mohaupt | 166/36 |
| 3,190,219 | 6/1965 | Venghiattis | 102/333 |
| 3,313,234 | 4/1967 | Mohaupt | 102/20 |
| 3,422,760 | 1/1969 | Mohaupt | 102/21.6 |
| 3,707,188 | 12/1972 | Heckman | 102/333 X |
| 3,806,025 | 4/1974 | Marshall | 102/325 X |
| 4,039,030 | 8/1977 | Godfrey et al. | 166/299 |
| 4,064,935 | 12/1977 | Mohaupt | 166/63 |
| 4,081,031 | 3/1978 | Mohaupt | 166/299 |
| 4,391,337 | 7/1983 | Ford et al. | 175/4.6 |
| 4,530,396 | 7/1985 | Mohaupt | 166/63 |
| 4,633,951 | 1/1987 | Hill et al. | 166/308 |
| 4,683,943 | 8/1987 | Hill et al. | 166/63 |
| 4,718,493 | 1/1988 | Hill et al. | 166/308 |
| 4,798,244 | 1/1989 | Trost | 166/250 |
| 4,823,875 | 4/1989 | Hill | 166/280 |
| 4,823,876 | 4/1989 | Mohaupt | 166/299 |
| 4,976,318 | 12/1990 | Mohaupt | 166/311 |
| 5,005,641 | 4/1991 | Mohaupt | 166/63 |
| 5,101,900 | 4/1992 | Dees | 166/250 |
| 5,131,472 | 7/1992 | Dees et al. | 166/308 |
| 5,253,585 | 10/1993 | Hudak et al. | 102/312 X |
| 5,259,316 | 11/1993 | Nelson et al. | 102/312 X |
| 5,271,465 | 12/1993 | Schmidt et al. | 166/297 |

*Primary Examiner*—Peter A. Nelson
*Attorney, Agent, or Firm*—Leonard W. Pojunas

[57] ABSTRACT

An overbalance technique propagates a fracture in a formation to stimulate hydrocarbon production from a wellbore. A liquid column in the wellbore is driven into the formation by a gas generator to propagate the fracture. The gas generator can be compressed gas or propellant which is placed within the wellbore near or in the liquid column. Preferably the gas generator is placed in the wellbore above the production zone. The gas generator can be conveyed via tubing, wireline, or coiled tubing. Typically the liquid is brine, water or oil. The liquid can be a resin to consolidate a weak formation, sand and gel to prop a fracture, or acid to etch a fracture face. The overbalance technique has applications to cased and openhole wellbores. In cased wellbores, the technique can be performed as the casing is perforated or after the casing is perforated.

27 Claims, 3 Drawing Sheets

METHOD AND APPARATUS FOR OVERBALANCED PERFORATING AND FRACTURING IN A BOREHOLE

This application is a continuation-in-part of prior application Ser. No. 07/975,497; Filed Nov. 10, 1992, and now U.S. Pat. No. 5,355,802.

FIELD OF THE INVENTION

The present invention relates generally to production of hydrocarbons from a borehole. More particularly, the present invention is a method and apparatus for perforating and fracturing a formation surrounding a borehole and propagating that fracture to increase hydrocarbon production from the borehole.

BACKGROUND OF THE INVENTION

Techniques for perforating and fracturing a formation surrounding a borehole are known in the art. The most common technique for perforating and fracturing a formation to stimulate production includes the steps of: 1) penetrating a production zone with a projectile; and 2) hydraulically pressurizing the borehole to expand or propagate a perforated hole into a fracture. This technique proves to be extremely expensive due to the preparation required for pressurizing a portion of a borehole. Typically, pressure around a production zone in the borehole is increased by pumping fluids into that portion of the well to obtain the high pressures necessary to expand the fracture in the production zones. This operation is generally time intensive and costly making these techniques unattractive for either multiple zone wells or wells with a low rate of production.

Perforations are done generally underbalanced, a lower wellbore pressure than reservoir pressure being applied to flush the tunnel just after the perforating. However, the perforation efficiency can be unpredictable with an underbalanced technique, the perforation efficiency being altered by perforation damage (crushed zone around the runnel) and/or the required underbalance to clean the perforation tunnel is unachievable. A review revealed inconsistent results achieved with underbalanced perforating, with an average perforation efficiency of less than 25%. In overbalanced perforating, a high pressure is applied to the cased wellbore before the shooting of the perforations. Higher production rates and negative productivity skin have been reported. For instance, 14 wells recently perforated with this technique showed a median negative completion skin factor of −2.0. Another reason to use an overbalance treatment comes from the problems of fracture initiation and fracture link-up which are dependent on the near wellbore stresses. It has been shown that the fracture opening surface is not generally a smooth surface and that there are a large amount of rock masses entrapped by connecting cracks. This situation could be greatly improved with overbalanced perforating which shall favor fracture link-up from each individual perforations. Overbalance-generated fracture may also initially align with the perforation axis.

Less expensive techniques using gas propellants have been implemented in place of hydraulic fracture propagation. The resulting procedure is similar to that discussed above. First, a projectile is fired to penetrate the production zone. Second, a propellant device is ignited to pressurize the zone of interest to initiate and propagate the fracture.

Godfrey et al., U.S. Pat. No. 4,039,030, describes a method using a propellant to maintain the pressure caused by a high explosive charge over a longer period. The high explosives are used to generate fractures while the role of the propellant is to extend these fractures. In accordance with this technique, the casing must be perforated prior to ignition of the high explosives and propellant as the high explosives are used exclusively to fracture the formation but not to perforate the casing.

Ford et al., U.S. Pat. No. 4,391,337, describes tin integrated perforation and fracturing device in which a high velocity penetrating jet is instantaneously followed by a high pressure gas propellant. In essence, a tool including propellant gas generating materials and shaped charges is positioned in a desired zone in the borehole. The penetrating shaped charges and propellant material are ignited simultaneously. The high pressure propellant material amplifies and propagates the fractures initiated by the shaped charges.

Dees et al., U.S. Pat. No. 5,131,472, and Schmidt et al., U.S. Pat. No. 5,271,465 concern overbalance perforating and stimulation methods which employ a long gas section of tubing or casing to apply high downhole pressure. Fluid is pumped downhole until the pressure in the tubing reaches a pressure above the fracture pressure of the formation. A perforating gun is then fired to perforate the casing. Because the applied pressure is enough to break the formation, fractures propagate into the formation. The gas column forces the fluid into the fractures and propagates them. Two issues can limit the use of this technique. First, the wellhead pressure must be compatible with safety limits. Generally the wellhead pressure is limited to 10,000 psi, and the required bottomhole pressure may not be achievable. As a rule of thumb overpressured well fracturing job should be done at 1.4 psi/ft. Specifically, the minimum applied pressure gradient is the formation fracturing gradient plus 0.4 psi/ft. Therefore, this overbalance technique can be unusable in deep wells. To increase the bottomhole pressure, a long section of the tubing is generally filled with liquid: a length of 1,000 m of liquid section is typical. However, this solution leads to the second limitation of the technique, mainly that long liquid section in small OD tubing will generate important friction losses due to the movement of the liquid inside the tubing. Friction losses will lower fracture propagation speed. As a result, leakage of the fracture fluid into the formation (seepage losses) through the fracture walls are much more important and the fracture extension can be greatly reduced.

In Hill, U.S. Pat. No. 4,823,875, the well casing is filled with a compressible hydraulic fracturing fluid comprising a mixture of liquid, compressed gas, and proppant material. The pressure is raised to about 1000 psi greater than the pressure of the zone to be fractured by pumping fluid downhole. The gas generating units are simultaneously ignited to generate combustion gasses and perforate the well casing. The perforated zone is fractured by the rapid outflow of an initial charge of sand-free combustion gas at the compression pressure followed by a charge of fracturing fluid laden with proppant material and then a second charge of combustion gas.

Although the prior art suggests downhole gas generators for use in fracturing operations, none drive a liquid column. These prior techniques have not proven attractive from an economical or technical point of view. In conventional hydraulic fracturing, even with the use of downhole propellant gas generators, a substantial amount of hydraulic power capability must maintained at the surface. None of the techniques have provided an economical process for perforating and fracturing as part of a single highly efficient operation.

SUMMARY OF THE INVENTION

The present invention concerns a method and apparatus for affecting fluid flow in a subterranean formation surrounding a borehole comprising: a) placing a liquid-containing column in the borehole: b) positioning a gas generator in the vicinity of the liquid column; c) activating the gas generator, such that gas is released to pressurize a portion of the borehole; and d) driving the liquid with the released gas to propagate a fracture into the formation with the liquid.

One embodiment involves pressurizing a section of the borehole using a liquid column and expanding a gas, generated close to the zone of interest. In this way, high pressure is delivered to increase bottom-hole pressure efficiently. By placing the gas generator close to the zone of interest, liquid friction losses are reduced, resulting in increased bottom-hole pressure. Also, resulting high speed fracture propagation minimizes fracturing fluid leakage into the formation. The increased bottom-hole pressure occurs in a short time (order of seconds) while the wellhead pressure is kept at a low level: surface high pressure pumps are not needed. Thus with this technique, safety increases and deeper wells can be treated. In addition, when used with a perforating tool, the fracturing process benefits from the energy of the shaped charges.

The invention also concerns a method of affecting the resistance to fluid flow in a formation surrounding a borehole comprising a) pressurizing a portion of the borehole with a gas generator; and b) initiating a fracture in a portion of the borehole after pressurizing a portion of the borehole.

One embodiment of the invention provides superior results to those obtained by the prior art because unlike the prior art, the pressure in the borehole is maximized when shaped charges are fired. Another aspect of the invention allows perforation of the casing and initiation of the fracture in a single step upon firing of the shaped charges. The efficiency of the invention is improved because a burning propellant or generated gas does not leak through the perforation during a time lag between perforation and propagation of the fracture. Further, high explosives which can crush the formation and which cannot be tailored with precision, are eliminated from the procedure. Instead, precise shaped charges having focused penetration points are used.

DESCRIPTION OF THE PREFERRED EMBODIMENT

Figure 1:
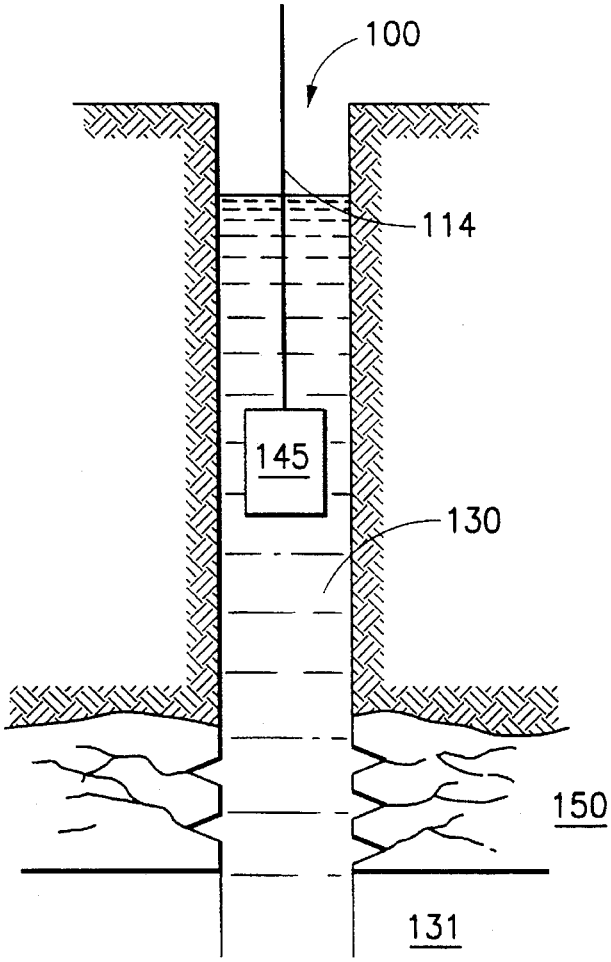
FIG. 1 is a schematic of the present invention.

FIG. 1 is a schematic of the present invention. According to the invention, an overbalance technique propagates a fracture in a formation to stimulate hydrocarbon production from a wellbore 100. Specifically, a liquid column 130 in the wellbore 100 is driven into the formation at a production zone 150 by a gas generator 145 to propagate the fracture 131. The gas generator 145 can be compressed gas, exploding gas, or propellant which is placed in the wellbore 100 within or near the liquid column 130. Preferably the gas generator 145 is placed in the wellbore 100 above the production zone 150. The gas generator 145 can be conveyed via an appropriate device 114 such as tubing, wireline, or coiled tubing. Typically the liquid column 130 is brine added by pumps or naturally occurring oil or water which has leaked into the wellbore, for example. The liquid column can comprise other fluids containing a liquid. The liquid 130 can be a resin to consolidate a weak formation, sand and gel to prop a fracture, or acid to etch a fracture face. The overbalance technique has applications to cased and open-hole wellbores 100. In cased wellbores, the technique can be performed as the casing is perforated or after the casing is perforated.

The gas generator 145 is placed in the vicinity of the production zone 150 to be treated. The gas generator 145 is "in the vicinity" of the production zone 150 if the gas generator 145 is above, adjacent, or below the production zone 150. However, the optimum placement of the gas generator 145 is in the liquid column 130 above the production zone 150 so the expanding gas of the activated gas generator 145 and the weight of the liquid column 130 work together. The distance between the gas generator 145 and the production zone 150 could be 20 meters, for example. This distance depends on the volume of the gas to be generated, applied pressure of the gas, thickness of the production zone 150, and in situ stress of the formation. This technique can be used with production zones which have already been perforated, or production zones which must be perforated.

For production zones which must be perforated, a perforating gun (see FIGS. 2*a*, 3*a*) is preferably fired after the gas generator 145 is activated to increase the speed and length of fractures 131. To maximize the fracture extension, two gas generators can be used, one below and one above the perforating gun (20 of FIGS. 2*a* and 3*a*). The distance between the two guns should maximize the amount of liquid 130 to be injected into the fractures 131. The gas generator 145 is activated first and the perforating gun is fired next by an electrical signal, after the pressure of the expanding gas has reached a threshold level, for example. Ignition of the gas generator 145 creates a gas column of 20–50 meters under a packer, if used. The expanding gas or burning propellant pressurizes the well in a short period of time, typically 0.01 sec. Resulting pressure is proportional to the mass of the tool over the volume of the wellbore 100. Expanding gas from the activated gas generator or burning propellant can drive liquid 130 into the perforations created by the perforating gun to fracture the formation. Again, the propagating liquid 130 can comprise brine or oil. Also the liquid 130 can comprise a resin for consolidating, sand and gel for propping a fracture, or acid for etching the face of a fracture.

Gas fracing alone, without use of liquid 130, can be performed. However, a gas-driven fracture exhibits more losses through the leakage of fracturing fluid into the fracture 131, compared to a liquid-driven fracture. Thus, it is preferable to drive liquid into the fracture 131 with the gas generator 145.

Figure 2A:
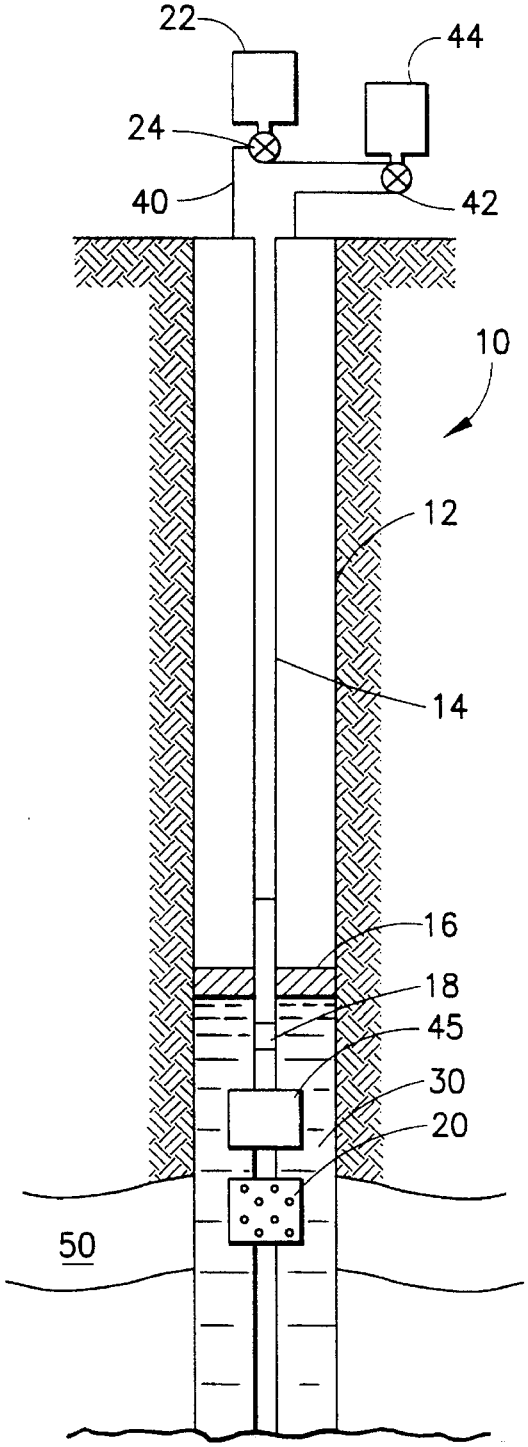
FIGS. 2*a–b* illustrate overbalancing of a borehole using a tubing-conveyed perforating gun.

FIG. 2*a* shows a cased well with tubing-conveyed gas generator and perforating gun. Casing 12 is placed in the well after drilling and cemented in the wellbore with cement, not shown. Tubing 14 is used to produce oil from the formation surrounding the wellbore. Casing 12 and Tubing 14 have sufficient burst strength to withstand the high pressures to be applied in the process. Attached near the bottom joint of tubing before it is placed in the well is a vent value 18, perforating gun 20, and gas generator 45. A ported sub may replace the vent value. In other cases a gun drop device may replace the vent valve. The tubing is placed in the well by conventional means and the packer 16 set by well known techniques so that a hydraulic seal across the packer is obtained to confine the high pressures that will be applied to the perforation zone. The tubing 14 is normally closed at the bottom when it is placed down the well so that it is dry inside when the packer 16 is set. By activating the gas generator 45, the expanding gas drives the liquid column 30 such that the pressure at the perforations will be above the fracture pressure of the formation 50. In this manner, liquid of the column 30 is driven to fracture the formation.

When the perforating gun 20 is combined with the gas generator 45, a number of techniques can be used to fire the perforating gun 20. A head for containing and dropping a bar 22 contains a release mechanism 24 which allows the bar 22 to fall through the tubing 14. The bar 22 passes through a vent valve 18 just before it hits the firing mechanism of the perforating gun 20. On passing through the vent valve 18, the bar opens the valve and activates the gas generator. Or, a firing head of a perforating gun can be activated by wellbore pressure. Typically, the gas generator 45 and perforating gun 20 could be 20 m apart on the tubing 14, for example. The distance between the gas generator 45 and perforating gun 20 is related to the thickness of the pay zone holding the producible gas or oil. However, the perforating gun 20 is not necessary when the casing 12 has been previously perforated.

Figure 2B:
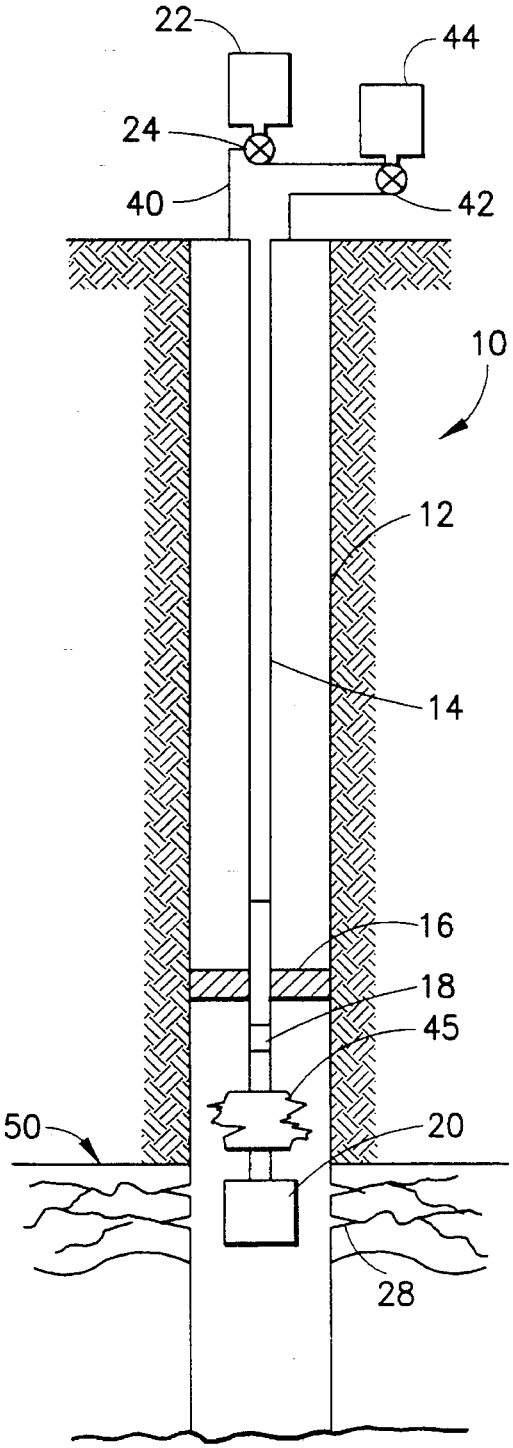

FIG. 2*b* shows cased well 10 with the vent valve 18 opened, perforations 28 formed and fractures 31 propagated. Liquid column 30 has been displaced from the wellbore by high pressure created by the gas generator 45. Liquid may be pumped by a pump 44 at the surface of the earth if necessary to increase the liquid column. The pumps are designed to pump liquid, liquid containing solid particles, gas or liquefied gas.

Figure 3A:
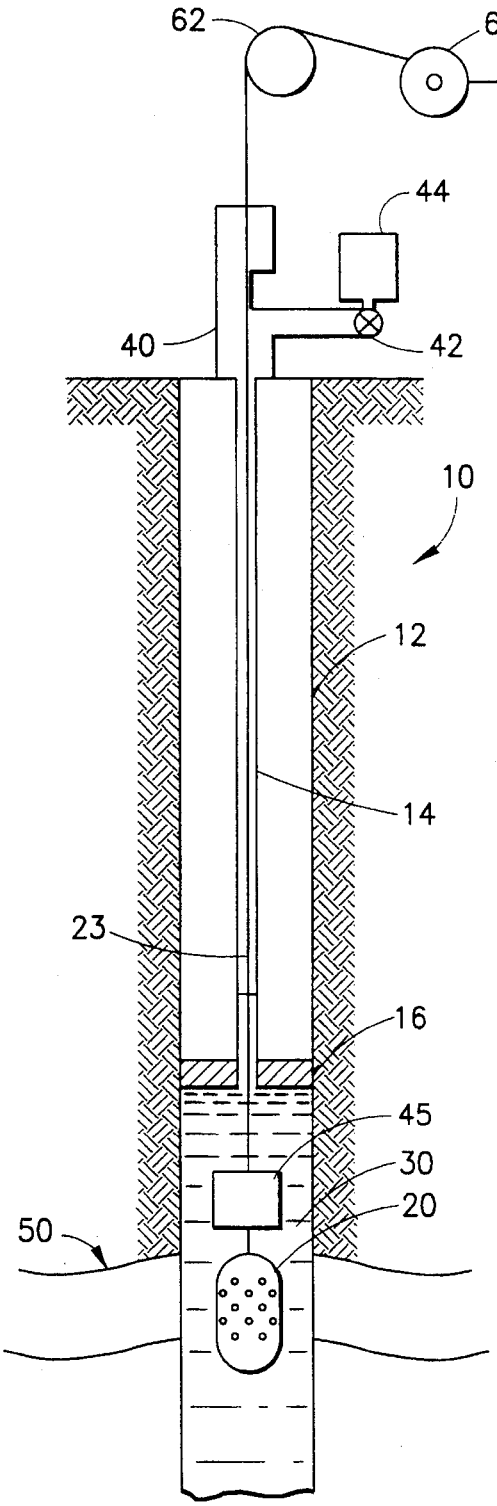
FIGS. 3*a–b* show the physical features and layout of a tool in accordance with the present invention.

Referring to FIG. 3*a*, the well 10 contains casing 12 and tubing 14. A packer 16 has been set to seal the annulus outside the tubing and prevent high pressures being applied to the casing above the packer 16. The formation 50 is the zone of interest. A perforating gun 21 and gas generator 45 have been run through the tubing on a wireline 23. The perforating gun 21 is placed opposite the formation 50, the gun being conveyed into the well by wireline 23 through the tubing 14. The gas generator 45 is discussed below. The perforating gun 21 may be either shaped charge or bullet. Any other method of forming holes in the casing would be equivalent. The wireline is supported at the surface of the earth by a sheave 62 and lowered into or retrieved from the well by a hoist 64. The electric wireline is connected to a control unit 66 for firing the gun and measuring depth. Fluid is pumped into the tubing by pump 44, if necessary to provide a liquid column. The pump 44 is designed to pump liquid, liquid containing solid particles, gas or liquefied gas. The gas generator 45 is activated to pressurize the wellbore near the production zone. The perforating gun 21 is fired from the control unit 66. The expanding gas of the generator 45 increases bottomhole pressure to drive the liquid column to fracture the formation.

Figure 3B:
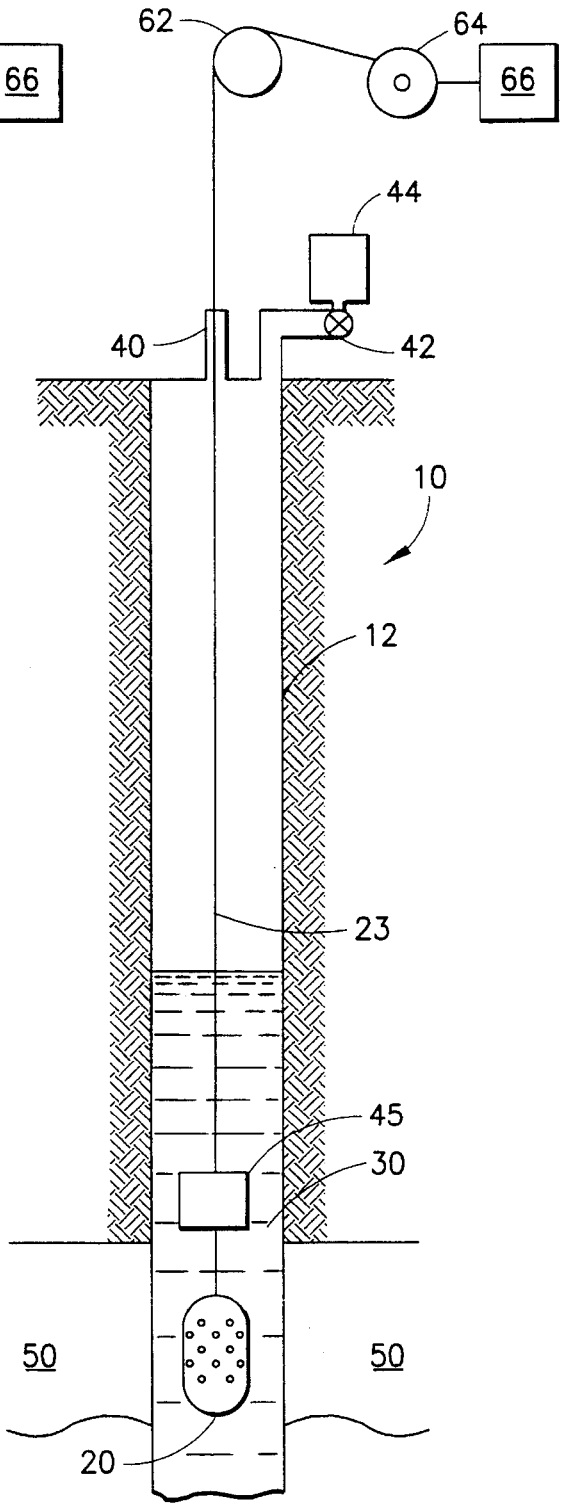

In one embodiment, the operation is directly wireline-conveyed as shown by FIG. 3*b*, without tubing. The system involves running a gas generator 45 and a perforating gun 20 drill collar down the wellbore (cased or openhole) directly on a wireline 23. The perforating gun is lowered in front of the zone to be perforated and a gas generator 45 is placed in the same string above, preferably, or below the perforating gun 20. Before the firing of the gas generator 45, the bottomhole pressure is set to an initial desired value by filling the wellbore with a fluid containing liquid as described above. The propellant or generated gas of the gas generator 45 pressurizes the wellbore before the firing of the shape charges. Alternatively, the wireline-conveyed technique is used in a wellbore which already has been perforated. In either case, the expanding gas of the generator 45 drives the liquid column 30 to fracture the formation with liquid.

The advantages of the tubing-conveyed method (FIGS. 2*a–b*) over the wireline-conveyed technique (FIGS. 3*a–b*) follow. The mass of the gas generator can be increased, because the mass of the generator is no longer a limit imposed by the strength of the cable. Use of a longer tool, and therefore heavier tool, will favor a longer fracture extension due to the increase of storage energy which is directly related to the mass of the gas generator. It will therefore allow a better flow connection between the wellbore and the formation. The gas generator diameter is only limited by the casing internal diameter, permitting use of a larger tool. A larger tool will carry more compressed gas or more propellant, and therefore will increase the storage energy. Large intervals or multizone wells can be completed efficiently with a single workstring, rather than having to make multiple runs on a wireline. In the wireline technique a combination of gas generator and perforating gun has to be used for each zone to be completed. A tubing conveyed method can be cost competitive over the wireline technique when the total cost (completion and rig costs) is considered. The distance between the two gas generating tools can be set to the desired value to optimize the fracturing process. The firing head of the perforating gun may be actuated by wellbore pressure to increase the safety and the efficiency of the operation. On the one hand when the bottomhole pressure exceeds a predetermined value related to the formation breakdown pressure, the gun will fire allowing the wellbore liquid to flow within the perforations. Thus, casing damage caused by excessive pressure will be avoided. On the other hand the time delay between the firing of the gas generator and the perforating gun is limited to the time required to boost the downhole pressure to the needed level to break the formation. The technique will therefore minimize energy losses through gas temperature decay due to heat exchange.

As already mentioned, higher fracture speeds are associated with the placement of high pressure gas close to the zone to be stimulated. By reducing the length of the section of the liquid column between the zone of interest and the gas column, lower friction loses will be obtained, contributing to higher wellbore pressure. This results in higher fracture speeds. Over current techniques, a speed factor of 10 can be obtained. The purpose of achieving higher fracture speeds is to minimize seepage losses and therefore concentrate the energy in the fracturing direction. Resulting fractures aligned perpendicular to stress (hydraulic type), as well as other fractures. If the fracture speed is first, the orientation of each fracture is determined by the associated perforation direction. The non-hydraulic fractures generated by the invention can cross natural fractures in the formation. As the hydrocarbon flow depends strongly on the number of fractures intersected, the present invention significantly enhances the well productivity.

Figure 4:
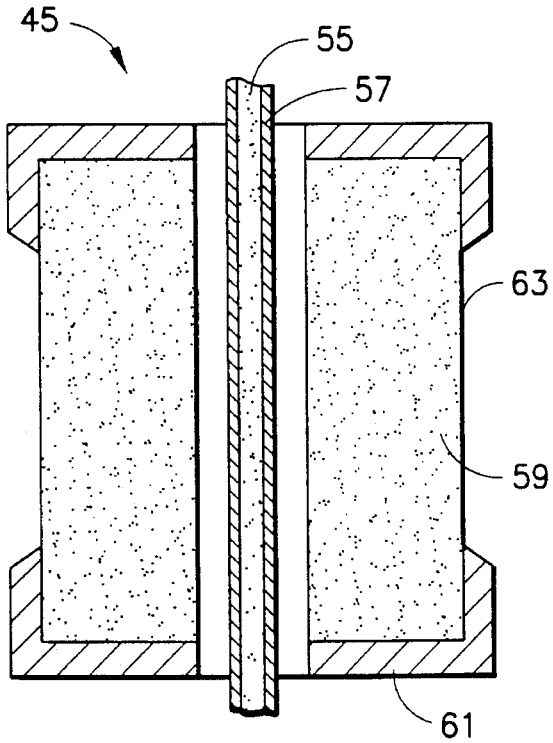
FIG. 4 is a more detailed schematic view of a gas propellant generating cartridge shown in FIGS. 3*a–b*.

FIG. 4 is an illustration of an individual gas generator cartridge 45. The gas generator can comprise a propellant which is burned or a compressed gas, like nitrogen, which is released from the gas generator 45. As an example, propellant 59 is packed in a housing 61 having lateral openings 63 along its side panels. These lateral openings 63 permit the escape of combustion products which form the propellant charge. Preferably, propellant 59 is in contact with the fluid filling the borehole and is protected from degradation by the borehole fluid by being formed in a resin polymerized unit.

As discussed in the parent application, the precise method of and timing between activation of gas generator 45 and the firing of shaped charges of the perforating gun 20 ensures that the pressure in the production zone has peaked and is just beginning to subside. In addition, a head of fluid of at least 100 meters above the tool position is important for tamping purposes. This head size ensures that there is no communication between the gas and the areas outside the production zone and has proved effective for maximizing pressure with minimal leakage of propellant fluid or pressurized gas up the borehole. The design of shaped charges should be such that they can be oriented in a particular direction. At the same time each shaped charge must be focused so that upon being fired, it perforates the casing or the formation wall without damaging the casing or crushing the formation. For example, a high explosive could damage the casing.

In conclusion, the present invention achieves numerous advantages over the prior art. The placement of a downhole gas generator creates a driving force close to the zone to be stimulated, resulting in deeper fracture propagation in the formation, greater fracture speed and less seepage as propagation occurs. Various alternatives, modifications and equivalents may be used. For example, the gas generator 45 may include a gas propellant or an alternative fluid like a compressed gas. Further, the optimum pressure levels for practicing the invention vary with depth, as well as other factors such as borehole diameter and the type of formation. One of ordinary skill in the art would recognize that these factors must be considered before selecting appropriate gas generator volumes and pressure levels. Although the invention has been discussed with respect to a wireline apparatus and in a tubing-conveyed type device, it could easily be implemented in any other type of borehole tool, like those conveyed with coiled tubing. Between the propellant tool and the perforating gun a tool carrying acid and/or proppant can be placed in the workstring to maximize the conductivity of the induced and natural fractures. A well-control valve can be used in the workstring to isolate the zone to be completed or/and to perform a well test. In this configuration the workstring allows the operator to complete the well by perforating the casing and creating short fractures and to perform a flow test immediately after completion. It can determine completion efficiency through well productivity measurements. Interpretation of the pressure measurement can also allow to estimate the fracture extension. In some wells, casing 12 already has perforations into the formation 50 (not shown). In such wells the method of this embodiment can be employed to plug or surge existing perforations by injecting solid particles into the well. Therefore, the above description should not be taken as limiting the scope of the invention which is defined by the appended claims.

What is claimed is:

1. A method of affecting fluid flow in a subterranean formation surrounding a borehole comprising:

(a) containing a fluid column in the borehole;

(b) positioning a non-explosive gas generator in the column at a first location along the borehole:

(c) activating the gas generator such that gas releases and pressurizes a portion of the borehole: and (d) driving the column generally from the first location towards a second location along the borehole with the released gas such that fluid of the column propagates a fracture into the formation at the second location.

2. The method of claim 1 wherein a liquid column is adjacent a production zone to be fractured at the second location.

3. The method of claim 1 wherein the gas generator is compressed gas which is released.

4. The method of claim 1 wherein the gas generator is a combustible propellant which is burned.

5. The method of claim 1, wherein shaped charges are fired through a casing in the borehole after the gas has been generated.

6. The method of claim 1, wherein the borehole contains a liquid column comprising an acid.

7. The method of claim 1, wherein the borehole contains a liquid column comprising a resin.

8. The method of claim 1, wherein the borehole contains a liquid column comprising a sand and gel mixture.

9. A method for propagating a fracture into a formation at a first location of a wellbore, the method being performed by a tool and comprising the steps of:

positioning the tool at a second location of a wellbore containing a fluid column, the second location being spaced along the wellbore from the first location;

activating a non-explosive gas generator of the tool to release a gas and pressurize a portion of the wellbore such that the fluid fractures the formation at the first location.

10. The method of claim 9 wherein a liquid column is adjacent a production zone to be fractured a the first location.

11. The method of claim 9 wherein the gas generator is compressed gas which is released.

12. The method of claim 9 wherein the gas generator is a combustible propellant.

13. The method of claim 9 wherein shaped charges are fired through a casing in the borehole after the gas has been generated.

14. An apparatus for propagating a fracture into a formation at a first location along a borehole, comprising:

a tool for positioning at a second location along the borehole a distance from the first location, the borehole containing a fluid column between the first and second locations; and;

a non-explosive gas generator in the tool for releasing gas and pressurizing the fluid column generally along the borehole from the second location toward the first location such that the fluid column propagates a fracture into the formation at the first location.

15. A method of affecting fluid flow in a subterranean formation surrounding a borehole comprising:

(a) positioning a non-explosive gas generator at a first location in the borehole, the borehole containing a fluid column;

(b) activating the gas generator such that gas releases and pressurizes a portion of the borehole: and (c) driving the fluid column with the released gas such that fluid of the column propagates a fracture into the formation at a second location along the borehole.

16. The apparatus of claim 15 wherein a liquid column is adjacent, a production zone to be fractured at the first location.

17. The apparatus of claim 15 wherein the gas generator is compressed gas which is released.

18. The apparatus of claim 15 wherein the gas generator is a combustible propellant.

19. The apparatus of claim 15 wherein the propellant is burned and the shaped charges are fired after the propellant has burned.

20. A method of affecting fluid flow in a formation surrounding a borehole comprising:

(a) pressurizing a fluid column in the borehole with a non-explosive gas generator at a first position of the borehole; and (b) initiating a fracture at a second position of the borehole as a result of pressurizing the fluid column.

21. The method of claim 20, wherein the gas generator is a compressed gas.

22. The method of claim 20, comprising placing the gas generator in the borehole with a wireline.

23. The method of claim 20, wherein the gas generator in the borehole is tubing-conveyed.

24. The method of claim 20, wherein the gas generator is a combustible propellant.

25. The method of claim 20, wherein the borehole contains a liquid column comprising an acid.

26. The method of claim 20, wherein the borehole contains a liquid column comprising a resin.

27. The method of claim 20, wherein the borehole contains a liquid column comprising a sand and gel mixture.

* * * * *